US008034230B2

(12) United States Patent
Lenglet

(10) Patent No.: US 8,034,230 B2
(45) Date of Patent: Oct. 11, 2011

(54) NON ASPHALTENIC OIL

(75) Inventor: Eric Lenglet, Rueil-Malmaison (FR)

(73) Assignee: IFP Energies Nouvelles, Rueil Malmaison Cedex (FR)

( * ) Notice: Subject to any disclaimer, the term of this patent is extended or adjusted under 35 U.S.C. 154(b) by 629 days.

(21) Appl. No.: 12/067,522

(22) PCT Filed: Sep. 14, 2006

(86) PCT No.: PCT/FR2006/002115

§ 371 (c)(1),
(2), (4) Date: Mar. 20, 2008

(87) PCT Pub. No.: WO2007/034052

PCT Pub. Date: Mar. 29, 2007

(65) Prior Publication Data

US 2008/0223751 A1 Sep. 18, 2008

(30) Foreign Application Priority Data

Sep. 21, 2005 (FR) ..... 05 09669

(51) Int. Cl.
*C10L 1/04* (2006.01)
*C10G 35/00* (2006.01)
*C10G 99/00* (2006.01)

(52) U.S. Cl. ..... 208/17; 208/94; 208/89; 208/58; 585/14

(58) Field of Classification Search ..... 208/85–89, 208/92, 94, 14–19, 58; 585/14
See application file for complete search history.

(56) References Cited

U.S. PATENT DOCUMENTS

| | | | | |
|---|---|---|---|---|
| 2,623,596 | A * | 12/1952 | Dyes et al. | 166/402 |
| 2,973,313 | A * | 2/1961 | Pevere et al. | 208/86 |
| 3,227,645 | A * | 1/1966 | Frumkin et al. | 208/89 |
| 4,592,830 | A | 6/1986 | Howell et al. | |
| 4,885,080 | A * | 12/1989 | Brown et al. | 208/218 |
| 2004/0069685 | A1 * | 4/2004 | Inomata et al. | 208/211 |
| 2004/0173503 | A1 * | 9/2004 | Stupin et al. | 208/108 |
| 2005/0167322 | A1 * | 8/2005 | Wellington et al. | 208/108 |

FOREIGN PATENT DOCUMENTS

| | | | |
|---|---|---|---|
| EP | 1 350 832 | A1 | 10/2003 |
| FR | 2 843 968 | A1 | 3/2004 |
| FR | 2843968 | A1 * | 3/2004 |

* cited by examiner

*Primary Examiner* — Glenn Caldarola
*Assistant Examiner* — Pamela H Weiss
(74) *Attorney, Agent, or Firm* — Millen, White, Zelano & Branigan, P.C.

(57) ABSTRACT

A reconstituted non-asphaltenic oil Pa comprising at least 28% by weight of naphtha N, having a ratio R of 1.5 or more and a gasoline potential, POTg, in the range 47 to 70, in which: R=(0.9 N+0.5 VGO+)/(MD+0.1 VGO+), POTg=0.9N+0.5 VGO+, with in % by weight: N=naphtha: [30° C./170° C.]; MD=middle distillates: ]170° C./360° C.] and VGO+=fraction boiling above 360° C.
R indicates the relative gasoline potential of a non residual oil over middle distillates during its subsequent refining.

8 Claims, 1 Drawing Sheet

NON ASPHALTENIC OIL

FIELD OF THE INVENTION

Figure 1:
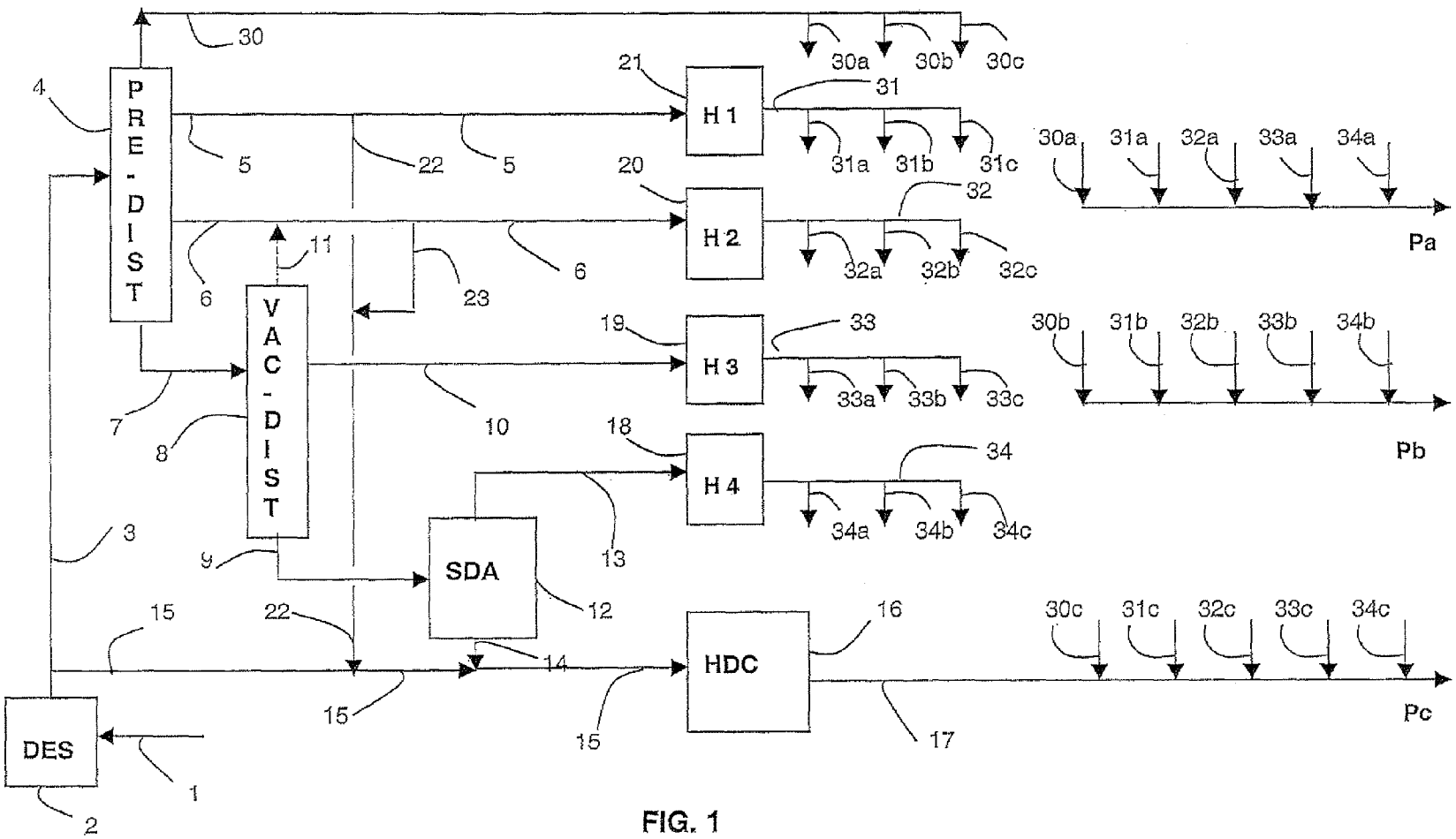

The present invention relates to the oil industry, and to the use of sulphur-containing heavy residues in the refinery. Oil is traditionally processed in the oil refinery by a set of operations of fractionation and chemical conversion to produce a set of final commercial products satisfying well defined standards, for example distillation cut points, sulphur contents, characteristic indices such as octane number or diesel index, etc.

The principal commercial end products are petrochemical naphtha, gasoline, kerosene, gas oil (also termed diesel fuel), domestic fuel, as well as various categories of fuels containing greater or lesser amounts of sulphur, road bitumen, liquefied petroleum gas, and occasionally other products: lubricating oils, solvents, paraffin, fuel for gas turbines, etc. An oil refinery thus produces a relatively large number of commercial end products, from a certain number of crude oils selected as a function of their composition and price.

Market development on the one hand, in particular increasing competition from natural gas, and specifications regarding discharges from combustion facilities on the other hand (discharge of oxides of sulphur, oxides of nitrogen, solid particles, in particular in Europe) result in severely limiting the openings for sulphur-containing heavy fuels, for example heavy fuel containing 3.5% to 4% of sulphur at most. Thus, refiners are confronted with a major technical problem, namely using sulphur-containing refinery residues, while satisfying regulations. Such sulphur-containing fuels typically do not satisfy specifications, and many states intend to limit the sulphur content of fuels to 1% of sulphur and in the future to 0.5% or even 0.3%.

Another trend in the use of oil products is a tendency to increase the consumption of middle distillates and gasoline while decreasing fuel, the increase in the consumption of middle distillates being faster than that of gasoline.

The invention concerns a process for pre-refining oil, typically in the production region, to improve the quality of oil with respect to these market changes.

PRIOR ART

French patent FR-04/02088 proposes the use of field gas, which is typically cheap, to pre-refine a conventional oil and typically to produce an oil Pa with a low sulphur content substantially free of asphaltenes, and a residual oil Pb (comprising starting asphaltenes, partially converted by a hydrogenating treatment). The oil Pa produced will, after refining, produce very little or no sulphur-containing fuel, and may have a high middle distillates content, which is ever more in demand on the market. This is high quality oil. The oil Pb typically comprises fractions of inferior quality, and in particular residual asphaltenes.

The corresponding process is a process for pre-refining crude oil, i.e. a process producing, as end products, pre-refined oils Pa, Pb (with improved quality, at least for Pa). Said (pre-refined) oils are typically sold, evacuated and transferred to the oil refineries. The pre-refining process also envisages the possible co-production of final commercial oil products: naphtha, gas oil, etc.

That prior art process thus produces a high quality oil Pa as demanded by the market. However, there is still a need to further improve matching of the market to the quality of the high quality oil proposed to satisfy the needs of the market and to enhance upgrading of the proposed product.

SUMMARY OF THE INVENTION

The invention proposes a process for pre-refining crude oil, generally conventional, to produce typically not two but at least three pre-refined oils Pa, Pb, Pc, two of which (Pa and Pb) are high quality oils, substantially free of asphaltenes, which after refining produce many high value products (naphtha, gasoline, middle distillates). In contrast, Pc is an oil with a residue containing asphaltenes and after refining will produce substantial quantities of fuel.

In accordance with one most preferred characteristic of the invention, the two oils Pa and Pb have different relative potentials as regards the (naphtha+gasoline/middle distillates) balance after conventional refining. Thus, a given refinery could be self-sufficient not only as regards its fuel requirements (by using oil Pc), but also by modifying the distribution of its supply of oils Pa and Pb to adapt itself to its own market and in particular to the (naphtha+gasoline)/middle distillates balance. A refinery located near urban zones will not have exactly the same gasoline/diesel distribution as a refinery located in a rural zone. There will also be differences for a refinery close to a petrochemicals complex cracking naphtha or for a refinery located close to a mountainous zone (increased consumption of domestic fuel because the climate is colder). Thus, the invention can match itself more closely to the market for each refinery. Thus, introducing a means for adjusting itself to the market means better access to said market and thus better upgrading of high quality oils Pa and Pb.

This adjustment means, which is refined and effective, is decoupled from fuel production, essentially linked to the use of residual oil Pc. Thus, the naphtha+gasoline/middle distillates balance may be adjusted independently of fuel production.

The invention proposes also, and more particularly, a reconstituted non-asphaltenic oil Pa having an unusually high gasoline potential and a relatively lower potential for middle distillates and gasoil, that can be obtained in particular by the process according to the invention. Nothing in the prior art, when trying to upgrade a crude oil, does suggest to pre-refine this crude oil so as to get such a final product, so different from what is known while nevertheless refinable, about which a man skilled in the art will recognise great technical advantages for some refiners as clients, in particular in North America. Furthermore, the prior art provides no teaching about means for getting Pa from crude oil P, which is typically very different from P. The invention is not contradictory with the world market requirement, whose general trend is on the contrary an increase of the middle distillates and gasoil potential over motor gasoline, since it allows correlatively to produce also another non asphaltenic crude oil Pb that has a high middle distillates and gasoil potential.

DETAILED DESCRIPTION OF THE INVENTION

The invention proposes a process for pre-refining oil which can produce, from a crude oil P (or a plurality of oils P1, P2, etc), typically at least 3 pre-refined oils Pa, Pb, Pc, Pa and Pb being high quality oils, i.e. oils which are substantially free of asphaltenes (compounds that are not soluble in heptane, according to the classical definition). The process may also optionally produce more than 3 pre-refined oils, for example 3 oils free of asphaltenes, or more. It may also produce 2 or 3 residual oils (containing asphaltenes) or more. The scope of the invention also encompasses the process co-producing end or refined products: fuel, naphtha, kerosene, gas oil, domestic fuel, oils or base oils, etc.

The invention proposes also, and more particularly, a reconstituted non-asphaltenic oil Pa having an unusually high gasoline potential and a relatively lower potential for middle distillates and gasoil, that can be obtained in particular by the process according to the invention.

The crude oil (or oils) P is typically conventional, but any type of crude oil may be used, whether conventional, heavy, asphaltic, and in particular any oil with an API degree in the range 5 to 50.

The process uses fractionation of the oil P by at least one initial distillation (termed "atmospheric") and generally vacuum distillation. The initial distillation preferably separates at least 2 fractions, one which is relatively richer in middle distillates and the other which is relatively richer in naphtha (or at least having different naphtha/middle distillate ratios).

The process also comprises at least one hydrotreatment unit, HDT, or conversion unit, in particular hydrocracking of vacuum distillate, VGO. It usually comprises a unit for deasphalting vacuum residue and a unit for hydrotreatment or hydrocracking the deasphalted oil DAO which is produced. Finally, it generally comprises a residue hydroconversion unit, HDC.

In accordance with one essential feature of the invention, the fractionations, conversions in the units and the distribution of the components of Pa and Pb are determined so that Pa is relatively rich in gasoline and naphtha precursors, and relatively poor in middle distillates: kerosene and diesel cut, while Pb, in contrast, is an oil which is relatively depleted in gasoline and naphtha precursors and relatively richer in middle distillates.

A substantially asphaltenes-free oil can be characterized by the ratio:

R=(0.9 N+0.5 VGO+)/(MD+0.1 VGO+), in which:

N=naphtha: % by weight of cut boiling (TBP distillation) between 30° C. and 170° C.;

MD=middle distillates: % by weight of cut boiling above 170° C. and below 360° C.;

VGO+=% by weight of fraction boiling above 360° C. It should be noted that, with oils Pa and Pb, VGO+designates fractions (typically hydrotreated or hydrocracked) of unconverted VGO and DAO, which are non asphaltenic (substantially free of asphaltenes).

If the yields obtained by conventional subsequent oil refinering are examined, the following can be established:

- the naphtha N may be about 90% converted to gasoline by reforming and isomerization;
- The VGO+, which in this case is free of asphaltenes and typically hydrotreated, may be about 50% converted into gasoline by catalytic cracking (FCC, or fluid catalytic cracking);
- The term POTg=(0.9 N+VGO+) is thus (for an oil with no asphaltenes) a good indicator of the gasoline potential of the oil during subsequent refining;
  - further, 10% by weight of gas oil from catalytic cracking (often termed LCO, light cycle oil) may generally be incorporated into the middle distillates, the remainder of the LCO being used as a fuel fluxing agent (diluent). The term (MD+0.1 VGO+) is thus a good indicator of the middle distillates potential of the oil during its subsequent refining.

As a result, the ratio R characterizes the gasoline potential with respect to the middle distillate potential: an oil with a high ratio R will produce relatively more gasoline while an oil with a low ratio R will produce relatively more middle distillates.

Typically, in accordance with the invention, the ratio Ra for oil Pa is higher than the ratio Rb for oil Pb. This can readily be obtained, for example, by incorporating relatively more naphtha N and/or unconverted VGO into Pa than into Pb, and in contrast by incorporating more middle distillates MD into Pb than into Pa. Decomposition of the initial oil into fractions having different naphtha, middle distillates and VGO+ contents allows ready reconstitution to enrich one or the other of the oils Pa, Pb in middle distillates or gasoline precursors. For the effluents from the conversion units, the conversion can be adapted and/or the VGO+ content of effluents can be measured (by distillation, chromatographic analysis, etc) to determine their naphtha, middle distillates and VGO+ contents to provide the desired reconstitution of Pa and Pb.

In general, the invention proposes a process for pre-refining at least one crude oil P with hydrogenating catalytic treatment of one or more cuts derived from P, comprising:

- at least one first step F1 for fractionation by initial distillation, PRE-DIST, to produce a first residue R1 and at least one first non asphaltenic (light) stream E1;
- at least one second step F2 for fractionation of at least a portion of R1 (i.e. a fraction of R1 or a fraction derived from R1) by vacuum distillation, VAC-DIST, and/or by solvent deasphalting, SDA, to produce at least one second non asphaltenic stream E2 and an asphaltenic residue R2;
- at least one hydrotreatment step, HDT, and/or hydroconversion step, HDC, and/or hydrocracking step, HDK, carried out on at least a portion of E2 to produce an effluent HE2;
- optionally, a hydroconversion step RHDC carried out on at least one asphaltenic fraction from R2;

in which the steps of fractionation and/or hydrogenating catalytic treatment of the process are determined so that at least two of the non asphaltenic effluents produced from P have different ratios R, in which:

R=(0.9 N+0.5 VGO+)/(MD+0.1 VGO+), in which:

N=naphtha: % by weight of cut boiling between 30° C. and 170° C. (for example, N=25 if 25% by weight of the effluent or the hydrocarbon stream under consideration is naphtha);

MD=middle distillates: % by weight of cut boiling above 170° C. and below 360° C.;

VGO+=% by weight of fraction boiling above 360° C.

The process also carries out the following steps:

a) at least two non asphaltenic oils, Pa and Pb, having different ratios R, i.e. Ra and Rb, are reconstituted and produced from the non asphaltenic effluents (substantially asphaltene-free) produced from P, optionally hydrotreated and/or hydroconverted and/or hydrocracked;

b) at least one residual oil Pc is produced, comprising at least the major portion of the asphaltenes of the asphaltenic residue R2 or at least the residual asphaltenes after hydroconversion, RHDC, if the process comprises said step. The scope of the invention encompasses producing not one but a plurality of residual oils Pc1, Pc2, etc, generally comprising the major portion of said asphaltenes.

Typically, Pa and Pb are essentially formed from fractions derived from the following group of cuts derived from P, optionally hydrotreated and/or hydroconverted and/or hydrocracked: naphtha N, middle distillates MD, intermediate gas oil IGO, light vacuum distillate LVGO, heavy LVGO or complete VGO, deasphalted oil DAO, with the following TBP distillation intervals:

N: [30° C./170° C.]; MD: [170° C./360° C.] IGO: [340° C./420° C.] LVGO: [360° C./450° C.]; HVGO: [450° C./565° C.] VGO: [360° C./565° C.] DAO: >565° C.

The expression ]170° C./360° C.] means that a compound boiling at 170° C. is outside the range, when a compound boiling at 360° C. is inside the range. But, since for petroleum cuts, the quantity of compounds boiling exactly at 170° C. or 360° C. is either very near zero or strictly equal to zero, the writing of the ranges (e.g. ]170° C./360° C.] or [170° C./360% C]) is quite indifferent according to the invention.

Since fractionations are not perfect, the scope of the invention encompasses said cuts being, for example, composed of at least 50% by weight of compounds in the respective distillation intervals which have been mentioned:

Typically, 1.10<Ra/Rb<4.5. Usually, 1.15<Ra/Rb<4. Preferably, 1.3<Ra/Rb<3. Highly preferably, 1.4<Ra/Rb<2.5.

Preferably, Pc comprises at least the major portion of effluent from ebullated bed RHDC hydroconversion of R2.

In one variation of the invention, R2 is a vacuum distillate VGO.

In another variation of the invention, R2 is asphalt, AS, obtained by solvent deasphalting, SDA. In this case, AS is often hydroconverted in an ebullated bed, supplemented by a liquid diluent DIL comprising at least 30% by weight of compounds boiling below 340° C.

Typically, the quantity of diluent is in the range 4% to 40% by weight of AS, preferably in the range 5% to 30% by weight of AS, and highly preferably in the range 6% to 25% by weight of AS.

DIL generally comprises 3% to 25% by weight, preferably 4% to 20% by weight, of AS, and highly preferably between 5% and 15% by weight of fractions boiling at 360° C. at most.

The solvent used for deasphalting is preferably relatively heavy (substantially heavier than propane) and thus produces an asphalt concentrated in asphaltenes. The solvents which can be used include all principally paraffinic hydrocarbons (possibly olefinic) containing 3 to 7 carbon atoms. Highly preferably, however, they comprise propane-butane mixtures, butane, pentane, hexane, heptane, light gasoline and mixtures obtained from said solvents. Preferred solvents include butane, pentane, hexane and mixtures thereof. Highly preferable solvents include butane, pentane and their mixtures.

The solvent deasphalting operation, SDA, may be operated under conventional conditions: reference should be made in this regard to the article by BILLON et al published in 1994 in volume 49, No 5 of the Institut Français du Pétrole review, pp 495 to 507, to the book "Raffinage et conversion des produits lourds du pétrole" [refining and conversion of heavy oil products] by J F Le Page, S G Chatila and M Davidson, Editions TECHNIP, pp 17-32, or to the description in French patent FR-B-2 480 773 or in FR-B-2 681 871 or to U.S. Pat. No. 4,715,946. Deasphalting may in particular be carried out at a temperature in the range 60° C. to 250° C. with one of said solvents, optionally supplemented by an additive. The solvents used and additives have in particular been described in the documents cited above and in the documents of U.S. Pat. No. 1,948,296; U.S. Pat. No. 2,081,473; U.S. Pat. No. 2,587,643; U.S. Pat. No. 2,882,219; U.S. Pat. No. 3,278,415 and U.S. Pat. No. 3,331,394. The solvent may be recovered by vaporization or distillation or by opticritical process, i.e. under supercritical conditions. Deasphalting may be carried out in a mixer-decanter or in an extractive column.

In a further variation of the invention, the asphalt is not converted: the untreated asphalt AS is mixed directly with one or more oil fractions, typically derived from P, to form the oil Pc, the vacuum residue then contains virgin asphaltenes in increased quantities compared with the vacuum residue of oil P. Typically, said oil fractions comprise at least one fraction of crude oil which is mixed with AS.

In a variation of the invention, Pa, Pb and Pc are formed so that the percentage of compounds boiling between 360° C. and 400° C. with respect to the VGO fraction is smaller for Pb than for P, and also for at least one of oils Pa, Pc. As an example, an IGO or LVGO fraction, after hydrotreatment or light hydrocracking, is preferably orientated towards Pa and/or Pc than towards Pa. It is also possible to convert more than 50% or more than 70% of IGO or LVGO and supply more effluent to Pa and/or Pc. This relative depletion of Pb in compounds boiling between 360° C. to 400° C. allows the middle distillates of Pb (MD/VGO fractionation) to be distilled more readily and thus allows increased quantities of middle distillates MD to be incorporated into Pb without causing problems with refining Pb at the initial distillation stage.

According to the invention, Pa, Pb and Pc are three oils, end products of the pre-refining process, each intended to be used as an initial distillation feed for one or typically a plurality of oil refineries.

Pa, Pb and Pc are end products of the pre-refining process; they are conventional oil refinery feeds and are not end products or intermediate refining products, or end products intended for a particular use. They each typically comprise at least 6% by weight of naphtha N, at least 10% by weight of middle distillates MD (for example at least 4% by weight of kerosene [170° C./250° C.] and at least 6% by weight of diesel cut [250° C./360° C.], and at least 10% by weight of vacuum distillate VGO.

In general, at least the major portion of Pa and Pb are transported separately by pipelines and oil tankers for their use as initial distillation feeds for one or, typically, more oil refineries.

In general, 0.7<Ra<4.0. Usually, 0.8<Ra<3. Preferably, 1.3<Ra<2.8. Highly preferably, 1.4<Ra/Rb<2.5.

The invention allows flexible reconstitution of each of the non asphaltenic oils Pa and Pb. If the oil Pa having the biggest gasoline relative potential is considered, the percentage of naphtha, that of the middle distillates MD and that of non asphaltenic VGO+can be selected at will. Thus, the ratio R can be arbitrarily determined by varying the components. It has also been found that it may be particularly advantageous as regards upgrading of the starting oil to produce a reconstituted oil not only having a high ratio R, but in addition having a high gasoline potential. Said oil will in particular have excellent upgrading capabilities in Japan or in the United States of America.

The invention thus also concerns a reconstituted non asphaltenic oil Pa comprising at least 28% by weight of naphtha N having a ratio R of 1.5 or more and a gasoline potential POTg in the range 47 to 70, with POTg=0.9 N+0.5 VGO+.

Generally, such reconstituted oil Pa comprise in the range 30% to 50% by weight of naphtha N, and has a ratio R greater than 1.6. Preferably, R is in the range 1.6 to 2.5 and a gasoline potential POTg in the range 50 to 70.

Said reconstituted oil Pa may in particular comprise in the range 30% to 50% by weight of naphtha N, have a ratio R greater than 1.7, for example in the range 1.75 to 2.5 and a gasoline potential POTg in the range 50 to 70, for example in the range 55 to 70.

Said reconstituted oil Pa may finally comprise in the range 36% to 50% by weight of naphtha N, a ratio R in the range 1.80 to 2.5 and a gasoline potential POTg in the range 58 to 70.

Said reconstituted oil Pa may readily be obtained by varying the amounts of naphtha, middle distillates and VGO+ at the time of reconstitution of Pa, Pb and Pc. A suitable method is to reconstitute Pa, then Pb, and finally Pc, preferably letting enough surplus of N, MD, VGO+ for Pc, so that Pc is a conventional fluid oil.

By way of example, if Pa is reconstituted with 35% by weight of naphtha N, 25% by weight of middle distillates MD and 40% by weight of non asphaltenic VGO+, we have:

R=(0.9*35+0.5*40)/(25+0.1*40)=1.776;

And POTg=(0.9*35+0.5*40)=51.5.

If the naphtha is increased and the middle distillates are lowered, R and POTg can readily be varied. If we take as an example: Pa with 40% by weight of naphtha N, 20% by weight of middle distillates MD and 40% by weight of non asphaltenic VGO+, then we have:

R=(0.9*40+0.5*40)/(20+0.1*40)=2.33;

and POTg=(0.9*40+0.5*40)=56.

After reconstituting Pa, it is easy to reconstitute Pb from a portion of remaining non asphaltenic cuts, letting enough surplus non asphaltenic cuts to get a third oil Pc including asphaltenes.

Thus, in accordance with the invention, it is easy to reconstitute non asphaltenic oils having variable ratios R and POTg, in particular high ratios, by adjusting their composition and by orientating surplus cuts towards the other reconstituted oils Pb and Pc.

A refinery could thus typically be self-sufficient in oil Pc to satisfy its residual fuel market, then to estimate, as a function of the refining yields for Pc, the relative requirements for naphtha, gasoline and middle distillates. The refinery thus can supply two oils Pa and Pb in suitable quantities, the distribution of which can be selected to adjust the (naphtha+gasoline)/middle distillates balance.

DESCRIPTION OF FIG. 1

Reference will now be made to FIG. 1 which shows a flow chart of the facility for carrying out the process of the invention.

A crude oil P, typically conventional (for example light Arabic), is supplied via a line 1 to a desalting unit 2. The desalted oil supplies, via a line 3, a preliminary distillation column PRE-DIST, with reference number 4 (usually termed initial distillation or atmospheric distillation) typically functioning at a pressure in the range 0.1 to 0.5 MPa. This column, which can optionally carry out a summary fractionation, produces a light stream, typically naphtha and lighter compounds, via a line 30, a middle distillates stream MD, typically kerosene and diesel cut via a line 5, and an intermediate gas oil stream, IGO, via a line 6, which may include fractions principally boiling between 340° C. and 420° C. Said intermediate gas oil, which is relatively heavy for an atmospheric column, may be obtained by dint of major vapour stripping.

Column 4 also produces an atmospheric residue via a line 7, which supplies a vacuum distillation column VAC-DIST with reference number 8. This column, which typically functions at a pressure in the range 0.004 to 0.04 MPa, produces a stream of vacuum distillate VGO via a line 10, and a vacuum residue stream VR via a line 9. It may also optionally produce a light vacuum distillate stream LVGO via a line 11.

The vacuum residue VR is supplied to a SDA unit with reference number 12 for solvent deasphalting (preferably using pentane) to produce a deasphalted oil DAO moving in a line 13 and a stream of asphalt AS evacuated via a line 14.

The asphalt AS is mixed with a stream of diluent DIL supplied via a line 15. Said stream typically comprises a stream of desalted oil supplied from line 3 via line 15 and/or a stream of middle distillates MD supplied from line 5 via a line 22 and/or a stream of intermediate gas oil IGO supplied from line 6 via lines 23 and 22. DIL may also comprise naphtha N removed from a line 30. The flow rate of the diluent with respect to the flow rate of asphalt AS is typically in the range 3% to 50% by weight, preferably in the range 4% to 40% by weight, in general in the range 5% to 30% by weight and more preferably in the range 6% to 26% by weight.

The mixture of asphalt and diluent (fluxed asphalt) then supplies the HDC ebullated bed hydroconversion unit with reference number 16. This unit typically comprises at least 2 and preferably at least 3 ebullated bed reactors in series.

At the outlet from the HDC unit, the hydroconversion effluent is supplemented by several streams moving in lines 30*c*, 31*c*, 32*c*, 33*c* and 34*c*. Said streams typically comprise naphtha N (line 30*c*), hydrotreated middle distillates MD (line 31*c*), hydrotreated or hydrocracked (generally partially) intermediate gas oil IGO (line 32*c*), hydrotreated or hydrocracked (generally partially) vacuum distillate VGO (line 33*c*), hydrotreated or hydrocracked (generally partially) deasphalted oil (line 34*c*). Thus, a (pre-refined) oil Pc is reconstituted from hydroconversion effluent, which comprises unconverted asphaltenic fractions and non asphaltenic fractions, typically hydrotreated or hydrocracked, and thus with a reduced sulphur content. Said oil Pc has a sulphur content which is much lower than that of the initial oil P.

The fractions MD, IGO, VGO, DAO are then hydrotreated and/or hydrocracked (typically partially) in units H1 with reference numbers 21, H2 with reference number 20, H3 with reference number 19 and H4 with reference number 18. Typically, H1 (and often H2) is a hydrotreatment, HDT, and H3 and H4 are mild hydrocracking units: M-HDK, medium pressure: MP-HDK, or high pressure: HP-HDK. Preferably, H4 is ebullated bed hydrocracking.

The light stream circulating in line 30 is subdivided into 3 elementary streams 30*a*, 30*b*, 30*c*.

The effluent from h1 moving in line 31 is subdivided into 3 elementary streams 31*a*, 31*b*, 31*c*.

The effluent from H2 moving in line 32 is subdivided into 3 elementary streams 32*a*, 32*b*, 32*c*.

The effluent from H3 moving in line 33 is subdivided into 3 elementary streams 33*a*, 33*b*, 33*c*.

The effluent from H4 moving in line 34 is subdivided into 3 elementary streams 34*a*, 34*b*, 34*c*.

A pre-refined oil Pa is formed by mixing streams 30*a*, 31*a*, 32*a*, 33*a* and 34*a*. Pa is an oil which is substantially free of asphaltenes since each of its components is also free thereof (the asphaltenes are uniquely contained in the AS stream). It is also an oil with a very low sulphur content since the majority of its components are desulphurized, and naphtha, supplied via the line 30*a*, is typically low in sulphur (it may optionally be hydrotreated).

In similar manner, a pre-refined oil Pb is formed by mixing streams 30*b*, 31*b*, 32*b*, 33*b* and 34*b*. For the reasons given for Pa, Pb is also an oil which is substantially free of asphaltenes and has a very low sulphur content.

In accordance with the invention, the conversions of the units and the distribution of the components of Pa and Pb for which Pa is relatively rich in gasoline and naphtha precursors and relatively poor in middle distillates: kerosene and diesel cut, is determined, while Pb, in contrast, is an oil which is relatively low in gasoline and naphtha precursors and relatively rich in middle distillates.

Typically, in accordance with the invention, the ratio Ra for oil Pa is higher than the ratio Rb for oil Pb. This may readily be achieved, for example by incorporating relatively more naphtha N and unconverted VGO+ into Pa (via lines 30*a* and 33*a*) than into Pb (via lines 30*b* and 33*b*), and in contrast by incorporating more middle distillates MD into Pb (via line 31*b*) than into Pa (via line 31*a*). Dividing the initial oil into fractions allows easy reconstitution to enrich one or the other of oils Pa, Pb in middle distillates or gasoline precursors. As regards the effluents from the conversion units, the conversion may be adapted and/or the amount of VGO+ in the effluents may be measured (by distillation, chromatographic analysis, etc) to determine their VGO+ contents.

In general, oils Pa and Pb are reconstituted so that Ra/Rb is more than 1.08 or even more than 1.12 or 1.2, in particular in the range 1.08 to 3.0; usually in the range 1.12 to 2.50; preferably in the range 1.20 to 2.0; and highly preferably in the range 1.25 to 1.80.

Before reconstituting the oils Pa, Pb, Pc, the process of the invention may use one or more catalytic steps using certain processes which are well known in the art, in particular desulphurizing treatments, hydrogen pressure treatments, which consume large or elevated quantities of hydrogen.

In the context of the present invention, the term "hydrogenating catalytic treatment" is used to denote a treatment comprising at least one of the treatments defined below and given the following abbreviations: HDT, HDC, HDK (which includes M-HDK, MP-HDK and HP-HDK), RHDT, RHDC. The following treatments can be distinguished:

a) Hydrotreatments (Denoted HDT) of Asphaltene-Free Feeds

The hydrotreatment of hydrocarbon distillates or deasphalted oil (feeds substantially free of asphaltenes) is known in the art. The principal aim is to at least partially eliminate undesirable compounds, typically sulphur, nitrogen, possibly metals such as iron, nickel or vanadium, etc. It is also frequently used for the hydrogenation of aromatics, generally simultaneously with feed desulphurization.

Conventionally, for those of the feeds cited above which include compounds boiling above 371° C., the term "hydrotreatment" is applied to a process wherein conversion of compounds boiling above 371° C. into compounds boiling below 371° C. is 20% or less. For processes treating the same feeds, but with a conversion of more than 20% by weight, the term "hydroconversion" (HDC) or "hydrocracking" (HDK) is used; these processes are described below.

Hydrotreatment processes functioning with pressurized hydrogen and using solid supported catalysts, typically granular solids or extrudates with a characteristic dimension (diameter for beads or equivalent diameter (corresponding to the same section) for extrudates) is in the range 0.4 to 5 mm, in particular in the range 1 to 3 mm. The operating conditions, in particular the hourly space velocity (HSV) and the molar ratio of hydrogen to hydrocarbon (H2/HC), vary depending on the cuts which are treated, the impurities which are present and the desired final specifications.

Non-limiting typical examples of the operating conditions are given in the table below:

| Oil cut | Cut point (° C.) | Space velocity ($h^{-1}$) | H2 pressure (bar) | Cycle start temperature (° C.) | H2/HC ratio ($Nm^3/m^3$) | H2 consumption (wt %) |
|---|---|---|---|---|---|---|
| Naphtha | 70-180 | 4-10 | 5-10 | 260-300 | 100 | 0.05-0.01 |
| Kerosene | 160-240 | 2-4 | 15-30 | 300-340 | 150 | 0.01-0.02 |
| Diesel & gas oil | 230-371 | 1-3 | 20-40 | 320-350 | 150-300 | 0.3-0.8 |
| Vacuum gas oil | 371-565 | 1-2 | 40-70 | 360-380 | 300-500 | 0.4-0.9 |
| Deasphalted oil | >565 | 0.5-1.5 | 50-110 | 360-380 | 500-1000 | 0.5-1 |

The hydrotreatment catalysts typically comprise a metal, a compound of a metal from group VIB and a metal or compound of a metal from group VIII on a support.

The most routine catalysts are composed of an oxide support and an active phase in the form of molybdenum sulphide or tungsten sulphide promoted by cobalt or nickel. The formulae usually used are CoMo, NiMo and NiW combinations for the active phase, and γ alumina with a large specific surface area for the support. The metal content is usually of the order of 9% to 15% by weight of molybdenum and 2.5% to 5% by weight of cobalt or nickel.

Certain of said catalytic formulae are occasionally doped with phosphorus. Other oxide supports are used, such as mixed oxides of the silica-alumina or titanium-alumina type.

Said supports are typically of low acidity, to obtain acceptable catalytic cycle times.

Examples of particular types of hydrotreatment catalyst for diesel, gas oil or vacuum gas oil cuts are HR448 and HR426 catalysts from AXENS, a French company.

When traces of metals, in particular nickel and vanadium, are present in the feed, a catalytic support with a porosity which is suitable for depositing said metals is advantageously employed.

An example of said catalyst is HMC841 from AXENS.

For the hydrotreatment of a deasphalted oil (DAO) including metals, a first bed with a HMC841 catalyst may, for example, be used for demetallization, then a second bed of HR448 for desulphurization and denitrogenation.

Other technical elements relating to hydrotreatment may be found in the reference work "Conversion processes" by P Leprince, Editions Technip, Paris 15$^{th}$, pages 533-574.

b) Processes for Hydrocracking (Denoted HDK) of Asphaltene-Free Feeds

Hydrocracking processes are also processes which are well known in the art. They are applied exclusively to feeds which are substantially free of asphaltenes or metals such as nickel or vanadium.

The hydrocracking feed is typically composed of a vacuum gas oil, sometimes supplemented with gas oil and/or deasphalted oil (deasphalted vacuum residue, typically using a solvent from the group formed by propane, butane, pentane and mixtures thereof, and preferably propane and butane).

It is also possible to carry out hydrocracking of deasphalted oil, DAO. The DAO must thus be of sufficient quality: typically, a hydrocracking feed comprises less than 400 ppm (parts per million by weight) of asphaltenes, preferably less than 200 ppm and highly preferably less than 100 ppm. The amount of metals (typically nickel+vanadium) in a hydrocracking feed is typically less than 10 ppm, preferably less than 5 ppm, and highly preferably less than 3 ppm.

Conventionally, a feed is considered to be substantially free of asphaltenes if its asphaltenes content is less than 400 ppm. (For a pre-refined oil, it is considered to be asphaltene-free or non-asphaltenic if the fraction boiling above 524° C. contains less that 400 ppm of asphaltenes).

Typically, the hydrocracking feed is initially pre-refined over a hydrotreatment catalyst, typically different from the hydrocracking catalyst. Said catalyst, typically with an acidity which is lower than that of the hydrocracking catalyst, is selected to substantially eliminate the metals, reduce traces of asphaltenes, and reduce organic nitrogen, which inhibits the hydrocracking reactions, to a value which is typically less than 100 ppm, preferably less than 50 ppm and highly preferably less than 20 ppm.

The hydrocracking catalysts are typically bifunctional catalysts having a double function: acid and hydrogenating/dehydrogenating.

Typically, the support has a relatively high acidity such that the ratio of the hydrogenating activity over the isomerizing activity, H/A, as defined in French patent FR-A-2 805 276, pages 1 line 24 to page 3 line 5, is more than 8, preferably more than 10 or more preferably more than 12, or even more than 15. Typically, hydrotreatment is carried out upstream of the reactor or the hydrocracking zone with a hydrotreatment catalyst with a ratio H/A as cited above of less than 8, in particular less than 7.

The hydrocracking catalysts typically comprise at least one metal or metallic compound from group VIB (such as Mo, W) and a metal or a metallic compound from group VIII (such as Ni, etc) deposited on a support. The atomic ratio of the metal from group VIII ($M_{VIII}$) to the sum of the metals from groups VIII and VIB, i.e. the atomic ratio $M_{VIII}/(M_{VIII}+M_{VIB})$, in particular for NiMo and NiW pairs, is usually close to 0.25, for example in the range 0.22 to 0.28.

The amount of metals is usually in the range 10% to 30% by weight.

The group VIII metal may also be a noble metal such as palladium or platinum, in an amount of the order of 0.5% to 1% by weight.

The acid support may comprise an alumina doped with a halogen or a silica-alumina of sufficient acidity, or a zeolite, for example a dealuminized USY or Y zeolite, usually having a double pore distribution with a double pore network comprising micropores with a dimension principally in the range 4 to 10 Å and mesopores with a dimension principally in the range 60 to 500 Å. The silica/alumina ratio of the zeolite structure is usually in the range 6.5 to 12.

As an example, it is possible to use a concatenation of hydrotreatment and hydrocracking with HR448 (HDT) and HYC642 (HDK) catalysts sold by AXENS. If the feed includes metals, a bed of demetallization catalyst such as HMC841, also sold by AXENS, may be used upstream of said two catalytic beds.

Examples of typical operating conditions for hydrocracking are as follows:

- hourly space velocity, HSV, between 0.3 and 2 $h^{-1}$;
- temperature in the range 360° C. to 440° C.;
- hydrogen recycle of between 400 and 2000 $Nm^3$ per $m^3$ of feed;
- the partial pressure of hydrogen and the total pressure may vary substantially depending on the feed and the desired conversion. By convention, conversion of 20% or more and less than 42% corresponds to mild hydrocracking (M-HDK); conversion of 42% by weight or more to less than 60% by weight corresponds to medium pressure hydrocracking (MP-HDK); conversion of 60% by weight or more (and typically less than 95% by weight) corresponds to high pressure hydrocracking (HP-HDK).

By definition, the conversion is that of products with a boiling point of more than 371° C. into products boiling below 371° C.

Typically, the partial pressure of hydrogen is, depending on the feeds, usually in the range from about 2 MPa to 6 MPa for mild hydrocracking, between about 5 MPa and 10 MPa for medium pressure hydrocracking and between about 9 MPa and 17 MPa for high pressure hydrocracking. The total pressure is usually in the range 2.6 to 8 MPa for mild hydrocracking, between about 7 and 12 MPa for medium pressure hydrocracking and between 12 and 20 MPa for high pressure hydrocracking.

The hydrocracking processes are typically carried out in fixed bed mode with granular solids or extrudates with a characteristic dimension (diameter for beads or equivalent diameter (corresponding to the same section) for extrudates) in the range 0.4 to 5 mm, in particular in the range 1 to 3 mm. The scope of the invention encompasses hydrocracking being carried out in moving bed mode (granular bed of catalyst typically in the form of extrudates or, as is preferable, beads with a dimension similar to those described for a fixed bed).

Other technical elements relating to hydrocracking can be found in the reference work "Hydrocracking Science and Technology" by J Scherzer and A J Gruia, Marcel Dekker, New York, and in the reference work "Conversion processes", P Leprince, Editions Technip, Paris 15$^{th}$, pages 334-364.

c) Processes for Hydroconversion (Denoted HDC) of an Asphaltene-Free Feed (for Example of the DAO Type) But Comprising Substantial Quantities of Metals (Ni, V):

Such processes are known which can produce conversions (with the same definition as for hydrocracking) of more than 20% by weight and frequently much higher (for example 20% to 50% or 50% to 85% by weight), for example in ebullated bed processes. Said processes can use variable partial hydrogen pressures, for example between 4 and 12 MPa, temperatures between 380° C. and 450° C., and hydrogen recycling of 300 to 1000 $Nm^3$ per $m^3$ of feed, for example. The catalysts used are similar or close to those used for residue hydrocracking or hydroconversion, defined below and have a porosity enabling them to have a substantial demetallization capacity.

As an example, a HTS358 catalyst sold by AXENS may be used.

d) Hydrotreatment of Residues (Denoted RHDT) or Hydroconversion of Residues (Denoted RHDC)

Processes for hydrotreatment of residues (and hydroconversion of residues) are processes which are well known in the art.

The operating conditions for said processes are typically: an hourly space velocity (or HSV) in the range 0.1 to 0.5. Partial pressure of H2 in the range 1 to 1.7 MPa. Hydrogen recycle between 600 and 1600 $Nm^3$ per $m^3$ of feed. Temperature 340° C. to 450° C.

The catalysts for fixed bed, moving or ebullated bed processes are usually supported macroscopic solids, for example beads or extrudates with a mean diameter in the range 0.4 to 5 mm. Typically, they are supported catalysts comprising a metal or a metallic compound from group VIB (Cr, Mo, W) and a metal or metallic compound from group VIII (Fe, Co, Ni, etc) on a mineral support, for example catalysts based on cobalt and molybdenum on alumina, or nickel and molybdenum on alumina.

For fixed bed hydrotreatment or hydroconversion, it is possible, for example, to use a hydrodemetallization catalyst HMC841, then hydroconversion and hydrocracking catalysts: HT318, then HT328 sold by AXENS.

For an ebullated bed, it is possible to use a catalyst of the HOC458 type, also sold by AXENS.

Catalysts for slurry processes are more diversified and may include coal particles or ground lignite particles impregnated with iron sulphate or other metals, worn ground hydrotreatment catalyst, molybdenum sulphide particles associated with a hydrocarbon matrix obtained by in situ decomposition of precursors such as molybdenum naphthenate, etc. The particle dimensions are typically less than 100 micrometers, or even lower.

Other characteristics of the processes and residue hydroconversion catalysts can be found in the general reference work "Raffinage et conversion de produits lourds du pétrole" [Refining and converting heavy oil products] by J F Le Page, S G Chatila, M Davidson, Editions Technip, Paris, 1990, in Chapter 4 (catalytic conversion in pressurized hydrogen) and chapter 3 para 3.2.3. Reference may also be made to the general reference work B: "Conversion processes", P Leprince, Editions Technip, Paris 15$^{th}$, pp 411-450, in Chapter 13 (residue hydroconversion), and to the general work "Upgrading petroleum residues and heavy oils", by Murray R Gray, published by Marcel Dekker Inc, New York, Chapter 5.

The hydrogen to carry out these various catalytic hydrogenating treatments may be produced from purified gas, for example by steam reforming over a nickel catalyst then CO steam conversion then purification, and is a known process described in reference B above, p 451-502, or in the reference work "The desulphurization of heavy oils and residues", J Speight, published by Marcel Dekker, Inc, New York.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The preceding examples can be repeated with similar success by substituting the generically or specifically described reactants and/or operating conditions of this invention for those used in the preceding examples.

The entire disclosures of all applications, patents and publications, cited herein and of corresponding French application No. 05/09.669, filed Sep. 21, 2005 are incorporated by reference herein.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A reconstituted non-asphaltenic oil Pa comprising at least 28% by weight of naphtha N, having a ratio R of greater than 1.7 and a gasoline potential POTg, in the range of 47 to 70, in which: R=(0.9 N+0.5 VGO+)/(MD+0.1 VGO+), and POTg=0.9N+0.5 VGO+, wherein:

N=naphtha, expressed as % by weight of cut boiling (TBP distillation) between 30° C. and 170° C.;

MD=middle distillates, expressed as % by weight of cut boiling above 170° C. and below 360° C.;

VGO+=% by weight of fraction boiling above 360° C.

2. A reconstituted oil according to claim 1, comprising 28% to 50% by weight of naphtha N.

3. A reconstituted oil according to claim 2, having a gasoline potential POTg in the range of 50 to 70.

4. A reconstituted oil according to claim 1, comprising 30% to 50% by weight of naphtha N, and a gasoline potential POTg in the range of 50 to 70.

5. A reconstituted oil according to claim 4, comprising 30% to 50% by weight of naphtha N, having a ratio R in the range of 1.75 to 2.5 and a gasoline potential POTg in the range of 55 to 70.

6. A reconstituted oil according to claim 5, comprising 36% to 50% by weight of naphtha N, having a ratio R in the range of 1.80 to 2.5 and a gasoline potential POTg in the range of 58 to 70.

7. A reconstituted oil according to claim 1, being a mixture of separate streams obtained by prerefining a crude petroleum.

8. A reconstituted oil according to claim 1, prepared by a process comprising at least one first step F1 for fractionation by initial distillation, PRE-DIST, to produce a first residue R1 and at least one first non asphaltenic (light) stream E1;

at least one second step F2 for fractionation of at least a portion of R1 (i.e. a fraction of R1 or a fraction derived from R1) by vacuum distillation, VAC-DIST, and/or by solvent deasphalting, SDA, to produce at least one second non asphaltenic stream E2 and an asphaltenic residue R2;

at least one hydrotreatment step, HDT, and/or hydroconversion step, HDC, and/or hydrocracking step, HDK, carried out on at least a portion of E2 to produce an effluent HE2;

optionally, a hydroconversion step RHDC carried out on at least one asphaltenic fraction from R2;

in which the steps of fractionation and/or hydrogenating catalytic treatment of the process are determined so that at least two of the non asphaltenic effluents produced from P have different R ratios.

* * * * *